US005932165A

United States Patent [19]

Corbett et al.

[11] Patent Number: 5,932,165

[45] Date of Patent: Aug. 3, 1999

[54] CERAMIC SPINNERETS FOR THE PRODUCTION OF SHAPED OR VOID CONTAINING FIBERS

[75] Inventors: W. James Corbett; Christopher H. Schiller, both of Cumming, Ga.; John A. MacPherson, Chula Vista, Calif.

[73] Assignee: NetShape Components, Inc., Alpharetta, Ga.

[21] Appl. No.: 08/844,233

[22] Filed: Apr. 18, 1997

Related U.S. Application Data

[60] Provisional application No. 60/015,591, Apr. 18, 1996.

[51] Int. Cl.[6] ..... B28B 1/24

[52] U.S. Cl. ..... 264/328.2; 264/629; 264/645; 264/669; 264/670; 264/317

[58] Field of Search ..... 264/629, 645, 264/317, 328.2, 669, 670

[56] References Cited

U.S. PATENT DOCUMENTS 5,047,181 9/1991 Occhionero ..... 264/328.2

5,250,251 10/1993 Fanelli ..... 264/645

5,308,556 5/1994 Bagley ..... 264/629

OTHER PUBLICATIONS

Corbett & Shaffer, 1987 Society of Manufacturing Engineers Technical Paper, "The Production of Advanced Ceramics by Injection Molding" Feb. 17, 1987, pp. 1–9.

*Primary Examiner*—James Derrington

*Attorney, Agent, or Firm*—Albert S. Anderson

[57] ABSTRACT

A ceramic spinneret used for producing manufactured fibers and formed from a fine grained, essentially pure structural ceramic such as aluminum oxide, zirconium oxide, composites of aluminum oxide and zirconium oxide known as toughed ceramics, silicon nitride, silicon carbide, or any fine grained essentially pure structural ceramic. Such spinnerets are formed as a single piece and contain non-circular capillaries suitable for forming shaped or void containing fibers.

5 Claims, 1 Drawing Sheet

CERAMIC SPINNERETS FOR THE PRODUCTION OF SHAPED OR VOID CONTAINING FIBERS

This application claims benefit of Provisional application No. 60/015,591, filed Apr. 18, 1996.

FIELD OF THE INVENTION

The field of invention is ceramic spinnerets, and more particularly ceramic spinnerets used for producing manufactured fibers of non-circular cross-section or which contain voids.

BACKGROUND OF THE INVENTION

It has long been recognized that superior spinnerets for manufacturing manmade fibers should be formed from ceramics, due to these materials' high strength, hardness, wear resistance, temperature resistant, and corrosion resistance. However, these materials are also very difficult and expensive to form and machine, and usually only simple shapes such as circles or cylinders can be formed economically. In addition, spinnerets used in most standard production processes are large, being several inches or more in diameter and up to an inch or more thick, and have formed in them multiple orifices which narrow at the bottom to very small (typical diameters ≦0.030"), precise holes known as capillaries, and these also are hard to achieve in the structural ceramic materials required for this application. See U.S. Pat. No. 3,825,456 issued to Weber et al, incorporated by reference, for an early attempt at producing these items; however, the method detailed could only be used for ceramic structures formed by recrystallizing an amorphous glass containing mixtures of the oxides of Ti, Al, Li, Mg, Si, etc.—as detailed in U.S. Pat. Nos. 2,684,911, 2,971,853, and 2,920,971, each of which is incorporated herein by reference,—and such structures do not have the strengths required for this application. In addition, it required the spinneret to be assembled from many different pieces, creating the possibility of weaknesses where these are joined.

In addition, many fibers currently being produced are not round, and require very precise, complex shaped capillaries in the spinneret. In the metal spinnerets currently being used, these capillaries are machined by electrical discharge (EDM) and broached, although some non-circular capillaries are also punched. These spinnerets are the most expensive to produce and suffer the most wear and damage in service; therefore, these applications would benefit the most from ceramic spinnerets. However, the most desirable ceramic materials for this application—essentially pure, fine grained technical ceramics such as aluminum oxide, zirconium oxide, silicon nitride, silicon carbide, and engineered composites of these materials—which possess the required strengths and wear resistance, cannot be produced by EDM, or broached, or punched, and only round orifices can be produced by conventional grinding techniques. Thus, while some spinnerets from these ceramic materials have been manufactured, they possessed only round capillaries. U.S. Pat. No. 3,620,703, incorporated herein by reference, details a method of producing non-circular orifices in a ceramic spinneret; however, this requires many individual pieces to be machined and assembled, creating possible weaknesses where the pieces are joined, and also only applies to opacifiable glass which can only produce glass and glass/ceramic structures that do not have the strength required for this application.

Therefore, there exists a need for production, multi-holed spinnerets with non-circular capillaries in essentially pure, fine grain ceramic materials of sufficient strength for this application—aluminum oxide, zirconium oxide, silicon nitride, silicon carbide and composites of these materials. In addition, there is a need for capillaries in these ceramic materials that will fabricate void free shaped fibers and for capillaries in spinnerets of these materials that can fabricate shaped or round fibers containing one or more voids in the fiber, such voids being produced by capillaries consisting of one or more shaped segments, such that the polymer on extrusion knits together during the spinning operation to form a hollow or void containing fiber.

SUMMARY OF THE INVENTION

The present invention provides multi-holed production spinnerets in aluminum oxide, zirconium oxide, and composites thereof with non-circular capillary orifices for the production of shaped fibers. This is achieved by the use of unique ceramic injection molding materials that allow the molding of such large, precise, complex shaped objects.

It is recognized in the art that complex shaped holes may be produced in small components in these materials by ceramic injection molding, such components are typically less than a 0.25" thick and weigh only a few grams. However, multi-holed production spinnerets are typically quite large—being several inches or more in diameter, approaching an inch in thickness, and weighing hundreds of grams. These are far beyond the capabilities of conventional ceramic injection molding. In addition, the tolerances on these orifices are in the microns, and such precision cannot be achieved with typical ceramic injection molding materials. Generally these materials use high molecular weight binders that must be molded at high pressures (>3000 psi). Such pressures often cause uneven packing of the compressible binders, leading to density gradients that cause uneven shrinkage when the ceramic part is fired, making dimensional control at the micron level impossible. In addition, the high molding pressures required often lead to segregation of the powder from the binder due to velocity effects, particularly in large components, and this also leads to density gradients and differential shrinkage on firing. In a spinneret, dimensional precision must be maintained at every orifice, as uniformity in size and shape of the orifices is the most critical parameter—if a single orifice is out of specification the entire piece must be discarded. Finally, high injection pressures will deflect the thin fragile core pins required to form the spinneret capillary. These are often ≦0.030" in overall diameter, and the pins used to form the multiple orifices required for the capillaries to form hollow or void containing fibers will often have members measuring only a few thousandths of an inch in thickness.

The large size of these components, the precision specified in the final part, and the fragility of the core pins used to produce the small, complex shaped orifices require that injection be performed at very low pressures. This requires a molding feedstock that is very low in viscosity (preferably, less than 30 Pa·s) in order to fill the mold cavity. In addition, the overall dimensional and process control possible with an injection molding material is directly related to the volume of ceramic powder contained in the molding material, with higher volumes of powder resulting in higher strengths during processing and lower overall shrinkage in the molding, debinding, and firing steps. This lower shrinkage results in statistically better control of the dimensional precision. However, increasing the volume of ceramic powder in the material tends to increase the viscosity of the molding material making molding at low pressures difficult, and even the higher pressure systems cited above can only achieve volume fractions of ceramic powder in the molding material of up to 60 vol %.

Using dispersion mechanisms previously thought unsuitable for ceramic injection molding systems, the inventors herein have developed ceramic injection molding materials that have the required low viscosity and can successfully mold large spinnerets at molding pressures of <200 psi. The injection molding materials make a ceramic powder slurry that has a viscosity less than 30 Pa·s at a temperature 40° F. above the melting point of the thermoplastic binder at shearing rates above 100 $s^{-1}$. These materials also contain a high volume of ceramic powder, at least 60% powder and preferably 70% or above, and maintain uniform dispersion of the ceramic powder during the molding process, such as is required for achieving the necessary precision in the final, fired component. These materials have been shown suitable for molding standard spinnerets with multiple spinning orifices such as are common in the manufactured fiber industry. These orifices may be shaped according to the configuration of the core pins which are molded around, and by using complex shaped core pins that create a male image of the desired configuration, capillaries can be formed that in the first part are suitable for forming shaped, void free fibers and/or hollow or void containing fibers. Due especially to its low viscosity, these materials can flow freely into the tiny crevices and fine details of the complex shaped core pins required to form non-circular capillaries, and, due to the high density of the material these fine details have the high strength required to remain intact through demolding and debinding. This technology can be used with any fine ceramic powder, including aluminum oxide, zirconium oxide, composites of zirconium oxide and aluminum oxide known in the art as zirconia toughened alumina, silicon nitride, silicon carbide, composites of any of these materials containing reinforcements such as ceramic fibers or whiskers, and any other fine, sinterable ceramic powder, as well as intermetallics such as titanium aluminide.

DETAILED DESCRIPTION OF THE PREFERRED EMBODIMENTS

Figure 1:
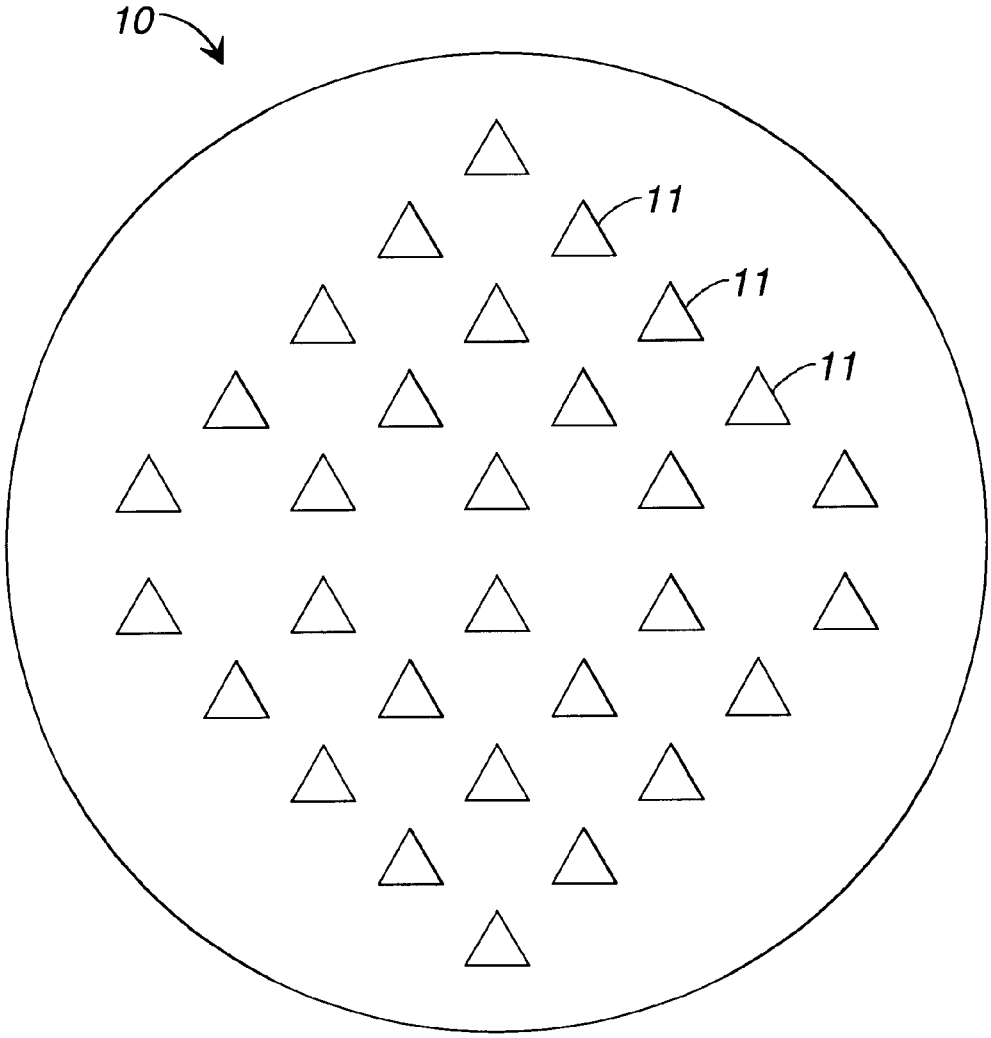
FIG. 1 is an elevation view diagram of a ceramic spinneret depicting the ceramic casting and orifices of an embodiment of the present invention.

A ceramic injection molding material consisting of 71.5% by volume aluminum oxide powder was prepared. The ceramic powder used had an average particle size of 2–3 $\mu$m with a broad size distribution down to nanometer sized particles; it is known that systems containing a range of particle sizes can contain higher volume fractions of powder at a lower viscosity than systems which contain particles of only one size. The remainder of the material consisted of thermoplastic binder to provide the material the low viscosity required for molding at low pressures. This binder consisted of essentially two-thirds paraffins, with the remainder a partially hydrogenated vegetable oil and various fatty acids, esters, and polymeric surfactants to enhance complete wetting and uniform dispersion of the ceramic powder in the binder.

Dispersion is maintained by a combination of steric and electrostatic repulsions between the particles, which is created by the surfactants. While steric stabilization is commonly used in ceramic injection molding, it has not previously been recognized that electrostatic repulsion can also be utilized in these systems. Paraffins are non-polar and it was assumed that electrostatic repulsive techniques would be ineffective. However, the surface of aluminum oxide is essentially basic in nature, and through the adsorption and desorption of certain acidic surfactants, an electrical potential is created in the binder sufficient to create a degree of electrostatic repulsion. Examples of suitable acidic surfactants would be oleic acid and montan wax. The use of such surfactants allows a reduction in the agents required for steric stabilization, effectively allowing a higher concentration of particles while still maintaining a low viscosity in the molten material.

This material was prepared in a standard, heated, double planetary mixer at a temperature 80° F. above the melting point of the binders. After thorough mixing to create uniform dispersion of the powders and thus reduce the material's viscosity to a level suitable for molding, the material was injected at 80 psi into a die configured to form a $\phi$80 mm×20 mm spinneret 10 with thirty holes 11 such as is standard in the monofilament industry. Among the hole configurations molded were round (not shown), slotted (not shown), triangular, and six pointed star (not shown).

The molded pieces were subsequently processed to remove the thermoplastic binder by methods known to those skilled in the art. These debindered artifacts were then fired to full density, forming ceramic spinnerets 10 with shaped holes 11 suitable for forming shaped or void containing fibers.

Other orifice shapes are possible, such as those shown in, e.g., U.S. Pat. Nos. 5,006,057; 5,125,818; 5,176,926; 5,259,753; 5,263,845; 5,330,348; and 5,388,980; each of which patents is incorporated herein by reference. While this invention has been described in detail with particular reference to preferred embodiments thereof, it will be understood that variations and modifications can be made to these embodiments without departing from the spirit and scope of the invention as described herein and as defined in the appended claims.

We claim:

1. A method of making a ceramic spinneret, comprising the steps of:

preparing a ceramic powder slurry of viscosity less than approximately 30 Pa·s and having at least 70% ceramic powder by volume dispersed in a thermoplastic binder comprising a plurality of surfactants; and injecting the ceramic powder slurry at a pressure of less than approximately 200 psi into a die to form a spinneret having at least one orifice with a non-circular cross-section, wherein the orifice is formed by molding around a core pin which defines the shape of the orifice.

2. The method of claim 1 wherein the ceramic powder slurry has a broad size distribution from nanometer-sized particles to micrometer-sized particles.

3. The method of claim 1 wherein at least one of said surfactants is selected to provide electrostatic stabilization of the ceramic particles in the thermoplastic binder.

4. The method of claim 3, wherein at least a second one of said surfactants is selected to provide steric stabilization of the ceramic particles in the thermoplastic binder.

5. The method of claim 1 wherein there are at least approximately thirty of said core pins forming at least approximately thirty of said orifices.

* * * * *